US012167789B2

(12) United States Patent
Ulrich et al.

(10) Patent No.: US 12,167,789 B2
(45) Date of Patent: Dec. 17, 2024

(54) DISK BROOM, SWEEPING DEVICE AND FLOOR CLEANING MACHINE

(71) Applicant: Hako GmbH, Bad Oldesloe (DE)

(72) Inventors: Bertram Ulrich, Stockelsdorf (DE); Carsten Protz, Altenkrempe (DE)

(73) Assignee: Hako GmbH, Bad Oldesloe (DE)

( * ) Notice: Subject to any disclaimer, the term of this patent is extended or adjusted under 35 U.S.C. 154(b) by 0 days.

(21) Appl. No.: 16/794,780

(22) Filed: Feb. 19, 2020

(65) Prior Publication Data

US 2020/0268138 A1 Aug. 27, 2020

(30) Foreign Application Priority Data

Feb. 21, 2019 (DE) ..... 102019104497.9

(51) Int. Cl.
*A46B 13/00* (2006.01)
*A47L 11/24* (2006.01)
(Continued)

(52) U.S. Cl.
CPC ..... *A46B 13/008* (2013.01); *A47L 11/24* (2013.01); *A47L 11/283* (2013.01);
(Continued)

(58) Field of Classification Search
CPC .... A46B 7/08; A46B 9/08; A46B 9/12; A46B 13/00; A46B 13/008; A46B 2200/3066;
(Continued)

(56) References Cited

U.S. PATENT DOCUMENTS 1,329,474 A * 2/1920 Pregler ..... A47L 11/1625 15/50.1
3,019,465 A * 2/1962 Bayless ..... A47L 11/4077 15/49.1
(Continued)

FOREIGN PATENT DOCUMENTS

CN 206090419 U 4/2017
DE 3605235 A1 8/1987
(Continued)

OTHER PUBLICATIONS

CES2012 EDUPACK, ABS properties, 3 pages (Year: 2013).*
(Continued)

*Primary Examiner* — Laura C Guidotti
(74) *Attorney, Agent, or Firm* — Reising Ethington P.C.

(57) ABSTRACT

A floor cleaning machine that includes a disc broom that is rotatable about a rotation axis. The disc broom has a base body, bristles and a cover element. The base body has a circumferential outer edge. The bristles are attached at one end to the base body and extend away from the base body towards a sweeping plane that is perpendicular to the rotation axis. The cover element has a shell that is made of a flexible material. The shell extends away from the base body and towards the sweeping plane. The shell has an inner side, which faces an interior of the shell, and an outer side that faces an exterior of the shell. The shell envelopes the bristles perpendicularly to the rotation axis such that the bristles are disposed in the interior of the shell. A related disc broom and sweeping device are also provided.

19 Claims, 3 Drawing Sheets

Figure 1:
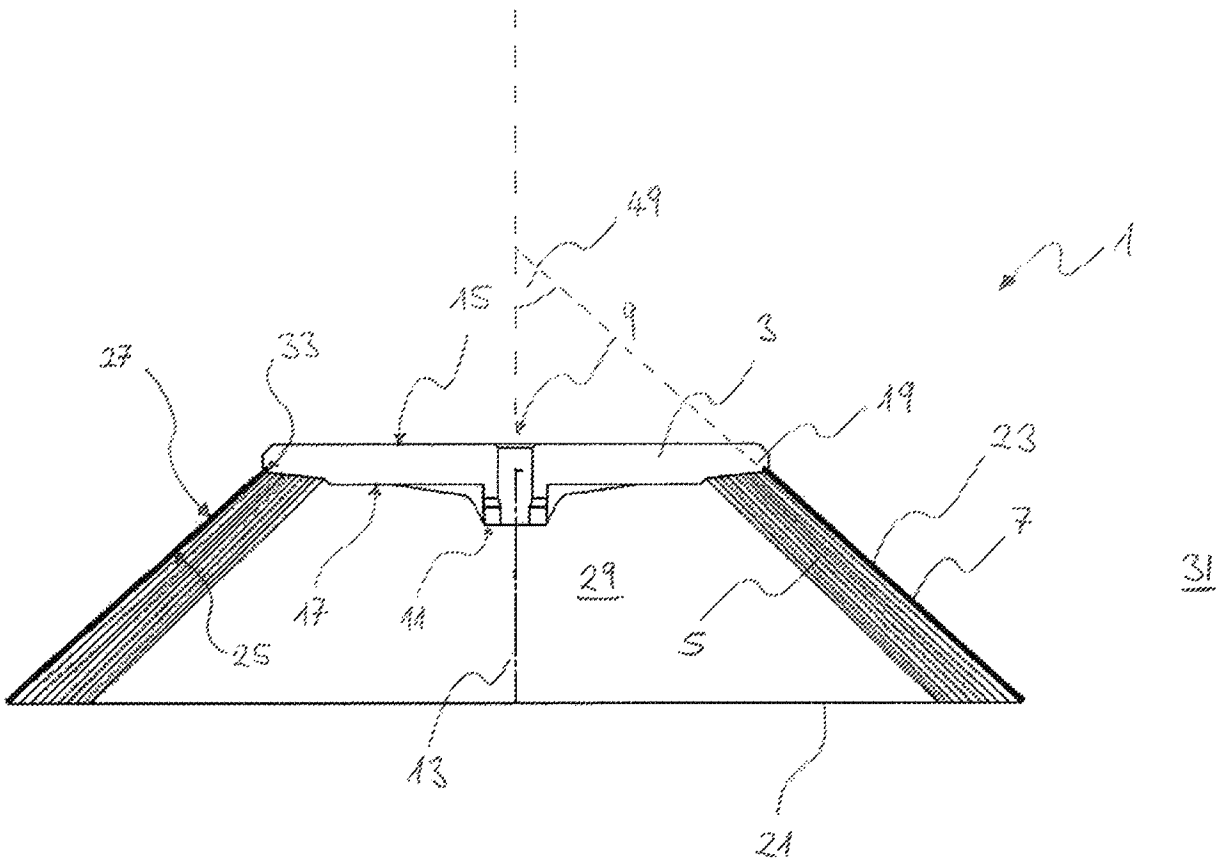

(51) Int. Cl.
*A47L 11/283* (2006.01)
*A47L 11/40* (2006.01)
*A47L 9/04* (2006.01)

(52) U.S. Cl.
CPC ..... *A47L 11/4038* (2013.01); *A47L 11/4077* (2013.01); *A46B 2200/3026* (2013.01); *A47L 9/0472* (2013.01); *A47L 11/4013* (2013.01)

(58) Field of Classification Search
CPC ..... A47L 11/16; A47L 11/162; A47L 11/164; A47L 11/283; A47L 11/293; A47L 11/2025; A47L 11/206; A47L 11/2065; A47L 11/305; A47L 11/4038; A47L 11/4077; A47L 11/24; A47L 11/40; A47L 9/0472; A47L 11/4044; E01H 1/04; E01H 1/05; E01H 1/053
USPC ..... 15/384, 385, 180, 49.1, 50.1, 87
See application file for complete search history.

(56) References Cited

U.S. PATENT DOCUMENTS 3,101,505 A 8/1963 Belica et al.
4,041,565 A * 8/1977 Hatley ..... A46B 13/008 15/180
6,202,243 B1 * 3/2001 Beaufoy ..... A47L 11/4008 15/339
7,533,435 B2 * 5/2009 Pedlar ..... A47L 11/302 15/340.1

FOREIGN PATENT DOCUMENTS

| | | | |
|---|---|---|---|
| EP | 2532788 | A2 | 12/2012 |
| GB | 2461536 | A | 1/2010 |
| JP | S51117454 | A | 10/1976 |
| JP | 2012085735 | A | 5/2012 |
| WO | WO/2014/122339 | A1 | 8/2014 |
| WO | WO/2014/199013 | A1 | 12/2014 |

OTHER PUBLICATIONS

"Young's Modulus (YM) for Common Test Materials", 2010, Jagdish Electronics, http://www.je-depa.com/Training/Tutorial/Appendix/YM%20for%20common%20materials.html#. (Year: 2010).*
"Elastomer Polyisoprene (natural rubber)" 2012, SubsTech Substances & Technologies, https://www.substech.com/dokuwiki/doku.php?id=elastomer_polyisoprene_natural_rubber. (Year: 2012).*
English Translation of First Office Action for German application No. DE1020019104497.9, filed Feb. 21, 2018.
Office Action issued to European counterpart application No. 20157506.5 on May 6, 2020.
Office Action dated Jan. 15, 2024 for related JP Pat. Appl. No. 2020-027098.

* cited by examiner

DISK BROOM, SWEEPING DEVICE AND FLOOR CLEANING MACHINE

CROSS-REFERENCE TO RELATED APPLICATIONS

This application claims the benefit and priority of German Patent Application No. DE 10 2019 104 497.9 filed on Feb. 21, 2019, the entire disclosure of which is incorporated by reference as if fully set forth herein.

FIELD

The present disclosure relates to a disc broom, a sweeping device, and a floor cleaning machine.

BACKGROUND

This section provides background information related to the present disclosure which is not necessarily prior art.

Disc brooms are known from the prior art. For example, disc brooms are used in sweeping devices of floor cleaning machines, wherein said disc brooms are rotatingly driven so as to, by way of the bristles thereof, convey swept material on a floor area to be cleaned in the direction of a receptacle of the floor cleaning machine such that the receptacle can receive the swept material from the floor area to be cleaned.

On account of the rotating disc brooms, the bristles of the disc brooms rotate about the rotation axis of said disc broom. The movement of the bristles about the rotation axis in turn causes an air flow into the region of the bristles, and thereafter radially away from the bristles, such that the swept material can be swirled prior to said swept material being able to be received by the receptacle. In particular when the swept material has a high dust content, a whirling-up of the swept material leads to whirled-up dust, which can float in the air for a comparatively long time and can settle in a widely distributed manner on surfaces. Consequently, it would be desirable to reduce the tendency for dust to be whirled-up dust when conveying swept material.

SUMMARY

This section provides a general summary of the disclosure, and is not a comprehensive disclosure of its full scope or all of its features.

In one form, the present disclosure provides a floor cleaning machine that includes a disc broom that is rotatable about a rotation axis. The disc broom has a base body, bristles and a cover element. The base body has a circumferential outer edge. The bristles are attached at one end to the base body and extend away from the base body towards a sweeping plane that is perpendicular to the rotation axis. The cover element has a shell that is made of a flexible material. The shell extends away from the base body and towards the sweeping plane. The shell has an inner side, which faces an interior of the shell, and an outer side that faces an exterior of the shell. The shell envelopes the bristles perpendicularly to the rotation axis such that the bristles are disposed in the interior of the shell.

Further areas of applicability will become apparent from the description provided herein. The description and specific examples in this summary are intended for purposes of illustration only and are not intended to limit the scope of the present disclosure.

DRAWINGS

The drawings described herein are for illustrative purposes only of selected embodiments and not all possible implementations, and are not intended to limit the scope of the present disclosure.

Figure 2:
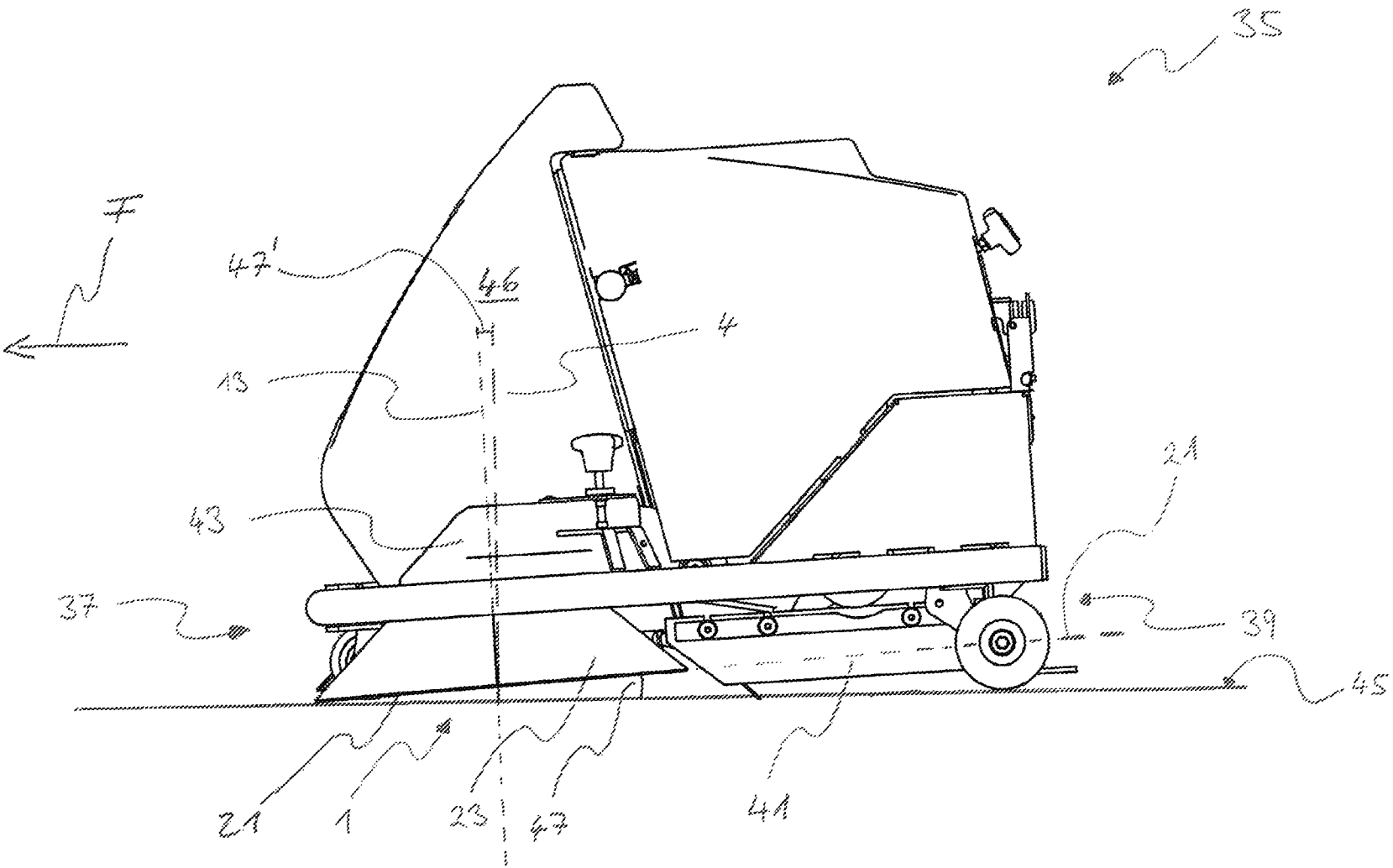
Figure 3:
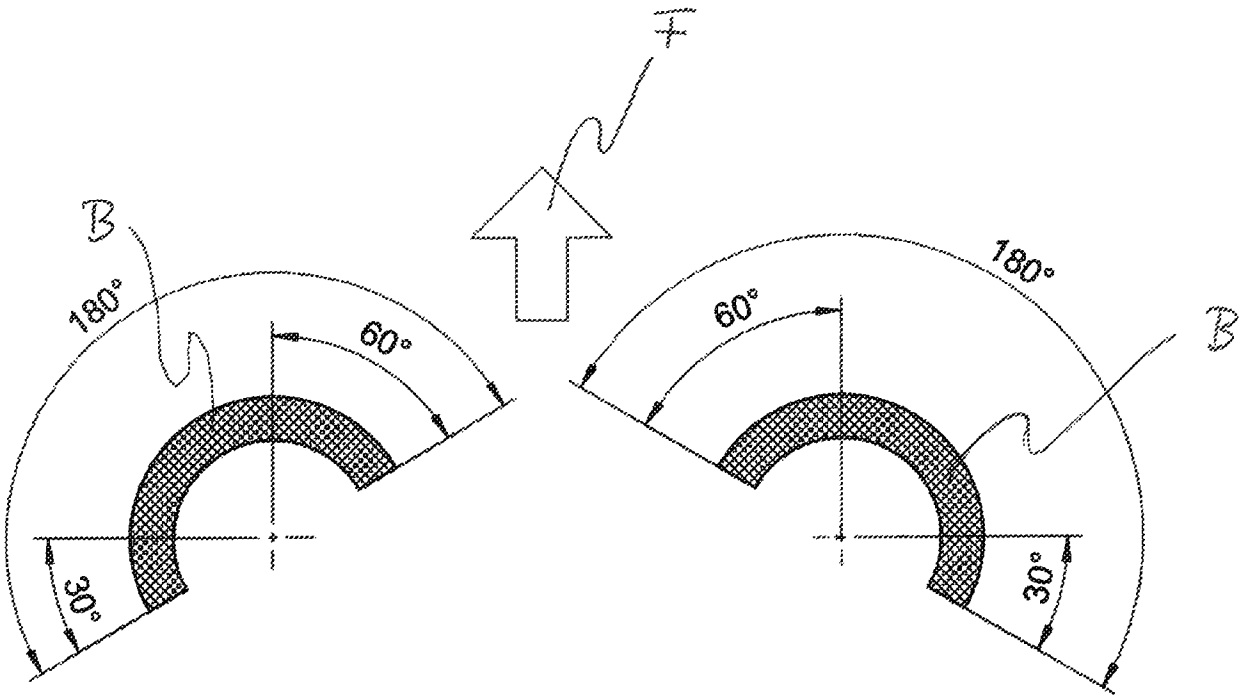

FIG. 1 is a schematic sectional view of an exemplary disc broom constructed in accordance with the teachings of the present disclosure;

FIG. 2 is a schematic lateral view of a portion of a floor cleaning machine constructed in accordance with the teachings of the present disclosure; and FIG. 3 is a schematic illustration of the portions of a floor area in which the bristles of the disc brooms of the floor cleaning machine of FIG. 2 engage with the floor area when sweeping devices of the floor cleaning machine are in a working position.

Corresponding reference numerals indicate corresponding parts throughout the several views of the drawings.

DETAILED DESCRIPTION

With reference to FIG. 1, a schematic sectional view of an embodiment of a disc broom 1 constructed in accordance with the teachings of the present disclosure is illustrated. The disc broom 1 has a base body 3, bristles 5, and a cover element 7.

The base body 3 has a recess 9 and a circumferential contact surface 11. The recess 9 and the contact surface 11 enable a rotatable coupling of the base body 3 about a rotation axis 13. The base body furthermore has an upper side 15 and a lower side 17 and a circumferential outer edge 19.

The bristles 5 are attached at one end to the base body 3 and extend away from the base body 3 and towards a sweeping plane 21 which is perpendicularly to the rotation axis 13. In this exemplary embodiment, the free ends of the bristles 5 remote from the base body 3 are arranged in the sweeping plane 21. In this exemplary embodiment, the bristles 5 are inclined in relation to the rotation axis 13 such that the free ends of the bristles 5 are at a greater distance from the rotation axis 13 than the ends which are attached to the base body 3.

The cover element 7 has a conical shell 23. The shell 23 has an inner side 25 and an outer side 27, and the inner side 25 faces an interior 29 of the shell 23. The outer side 27 faces an exterior 31 of the shell 23. The shell 23 extends away from the outer edge 19 and towards the sweeping plane 21. The cover element 7 has an attachment section 33 which is attached to the outer edge 19 of the base body 3. The attachment section can be adhesively bonded and/or affixed to the outer edge 19.

The shell 23 can be formed from a flexible material. In the example provided, the flexible material is formed from a natural rubber, has a glass transition temperature of at most 0° C., and has a Young's modulus of at most 5 GPa. Particularly high sweeping effects and a simultaneously minor whirling up of the swept material has been demonstrated when the flexible material is formed from LINATEX®.

The shell 23 envelopes the bristles 5 perpendicularly to the rotation axis 13 in such a way that the bristles 5 are arranged in the interior 29 of the shell 23.

The envelope of the bristles 5 perpendicular to the rotation axis 13 by the shell 23, such that the bristles 5 are arranged in the interior 29 of the shell 23, can reduce or eliminate air flows towards the bristles 5 and away from the bristles 5. In particular when the bristles 5 move about the rotation axis 13, air flows between the interior 29 of the shell and the exterior 31 of the shell are reduced due to the shell 23. The whirling up of swept material before it can be received by a swept material receptacle 41 (see FIG. 2) is likewise reduced by reducing the air flows. Therefore, in case the swept material has a high dust content, the amount of whirled-up dust can be reduced.

The shell 23 is configured as a closed surface such that there is no fluid connection through the shell 23 between the exterior 31 of the shell 23 and the interior 29 of the shell 23. By inhibiting a fluid connection through the shell 23, it is possible to inhibit the flow of air through the shell 23 towards the bristles and to inhibit the flow of air through the shell 23 away from the bristles so that whirling up of the swept material can be further inhibited.

The inner side 25 of the shell 23 forms a shell angle 49 with the rotation axis 13 of 48 degrees. A shell angle 49 of 48 degrees is only exemplary. Especially when the shell 23 moves about the rotation axis 13, the shell angle 49 can also have other values.

In FIG. 2, a schematic lateral view of a part of an exemplary floor cleaning machine constructed in accordance with the teachings of the present disclosure is shown, wherein the part is configured as a sweeping attachment 35. The sweeping attachment 35 has sweeping devices 37, which are each attached to the sides, a chassis 39, and a swept material receptacle 41, in particular a dust receptacle.

The sweeping devices 37 comprise the disc broom 1 illustrated in FIG. 1, the shell 23 of said disc broom 1 being illustrated in FIG. 2. Moreover, the sweeping devices 37 have a rotary drive 43. The base body 3 (see FIG. 1) of the disc broom 1 is coupled to the rotary drive 43 for rotation about the rotation axis 13. The sweeping devices 37 are adapted for use as part of a floor cleaning machine, here as part of a sweeping attachment 35. The sweeping devices 37 can also be used as part of a sweeper, a vacuum sweeper, a scrubbing machine, or a vacuum scrubbing machine.

The chassis 39 is configured for moving the sweeping attachment 35 over a floor area 45 to be cleaned. The swept material receptacle 41 is configured for conveying swept material, in particular dust, from the floor area 45 to be cleaned into a receiving container 46 of the sweeping attachment 35. The sweeping attachment 35 is configured for cleaning the floor area 45 of dust.

As is illustrated in FIG. 1, the upper side 15 of the base body 3 faces away from the interior 29 of the shell 23, and the lower side 17 faces the interior 29 of the shell 23. When the base body 3 is coupled to the rotary drive 43 as in FIG. 2, there is no fluid connection through the base body 3 between the interior 29 of the shell 23 and the upper side 15 of the base body 3. By avoidance of a fluid connection through the base body 3 when the latter is coupled to the rotary drive 43 and the bristles 5 move about the rotation axis 13, an air flow through the base body 3 towards the bristles 5 is inhibited, as is an air flow through the base body 3 away from the bristles 5. The inhibiting of these air flows through the base body 3 can further reduce a whirling up of the swept material.

The disc broom 1 of the sweeping devices 37 can be moved from a transport position into a working position shown in FIG. 2. In the transport position, the bristles 5 and the cover element 7 are spaced apart from the floor area 45 such that the sweeping attachment 35 can move towards the floor area 45 to be cleaned and away from the floor area 45 to be cleaned without a partial quantity of the bristles 5 and a portion of the cover element 7 engaging with the floor area 45. In the working position, a partial quantity of the bristles 5 and a portion of the cover element 7 engage with the floor area 45 to be cleaned. When the base body 3 rotates caused by the rotary drive 43 of the sweeping device 37, swept material is conveyed from the floor area 45 to be cleaned through the bristles 5 and the cover element 7 to an inlet of the swept material receptacle 41, and conveyed from the latter into a receiving container 46 of the sweeping attachment 35.

In the working position, the sweeping plane 21 in the particular example provided herein is arranged at a sweeping angle 47 of approximately 5 degrees to the floor area 45 to be cleaned. A sweeping angle 47 of 5 degrees is only exemplary. In particular when the sweeping attachment 35 moves over the floor area 45 to be cleaned, the sweeping angle 47 can also have other values. The sweeping angle 47 between the sweeping plane 21 and the floor area 45 to be cleaned corresponds to the inclination angle 47' of the rotation axis 13 of the disc broom 1. When the disc broom 1 is positioned in the working position in the example provided, the rotation axis 13 is inclined by 5 degrees to the side and by 5 degrees to the front in the travel direction F of the sweeping attachment 35.

FIG. 3 shows in a top view as hatched regions B relative to the travel direction F of the sweeping attachment 35 those portions of the floor area 45 to be cleaned with which the partial quantities of the bristles 5 of the disc brooms 1 engage due to the oblique position of the rotation axes 13. The regions B extend over 180 degrees in total. Furthermore, said regions B extend by 60 degrees inwards towards the center of the sweeping attachment 35 in relation to the travel direction F, and by 30 degrees backwards in relation to the travel direction F. Finally, the rotary drives 43 of the sweeping devices 37 are configured such that the disc brooms 1 rotate in opposite directions in such a way, when they engage with the floor area 45 to be cleaned, that the bristles 5 which engage in the regions B with the floor area 45 to be cleaned move towards the center of the sweeping attachment 35. As a result, dirt on the floor area 45 is moved towards the center of the sweeping attachment 35.

The foregoing description has been provided for purposes of illustration and description and is not intended to be exhaustive or to limit the disclosure. Individual elements or features of a particular example are generally not limited to that particular example, but, where applicable, are interchangeable and can be used in a selected example, even if not specifically shown or described. The same may also be varied in many ways. Such variations are not to be regarded as a departure from the disclosure, and all such modifications are intended to be included within the scope of the disclosure. It is additionally to be pointed out that "having" and "comprising" does not exclude other elements or steps, and that "a" does not exclude a multiplicity.

| List of reference signs | |
|---|---|
| 1 | Disc broom |
| 3 | Base body |
| 5 | Bristles |
| 7 | Cover element |
| 9 | Recess |
| 11 | Contact surface |
| 13 | Rotation axis |
| 15 | Upper side |
| 17 | Lower side |
| 19 | Outer edge |
| 21 | Sweeping plane |

-continued

| List of reference signs | |
|---|---|
| 23 | Shell |
| 25 | Inner side |
| 27 | Outer side |
| 29 | Interior of the shell |
| 31 | Exterior of the shell |
| 33 | Attachment section |
| 35 | Sweeping attachment |
| 37 | Sweeping device |
| 39 | Chassis |
| 41 | Swept material receptacle |
| 43 | Rotary drive |
| 45 | Floor area |
| 46 | Receiving container |
| 47 | Sweeping angle |
| 47' | Inclination angle of rotation axis |
| 49 | Shell angle |

What is claimed is:

1. A floor cleaning machine comprising:

a disc broom that is rotatable about a rotation axis, the disc broom having a base body, bristles and a cover element, the base body having a circumferential outer edge, the bristles having proximal ends and distal ends, the proximal ends of the bristles being attached the base body, the bristles extending away from the base body and terminating at the distal ends in a continuous planar shape, all of the distal ends cooperating to define a sweeping plane, the sweeping plane being perpendicular to the rotation axis, the cover element having a shell that is made of a flexible elastomeric material that is capable of flexing with the bristles, the shell extending away from the base body toward the sweeping plane, wherein the shell has an inner side, which faces an interior of the shell, and an outer side that faces an exterior of the shell, wherein the shell envelopes the bristles perpendicularly to the rotation axis such that the bristles are disposed in the interior of the shell;

wherein the cover element has an attachment section, and wherein the attachment section is attached to the base body at an outer edge thereof, the cover element extending to the sweeping plane.

2. The floor cleaning machine of claim 1, wherein at least a radially outer portion of the bristles relative to the rotation axis extends inclined to the rotation axis such that the distal ends of the at least the radially outer portion of the bristles are at a greater distance from the rotation axis than the proximal ends which are attached to the base body; and wherein the shell has a conical profile.

3. The floor cleaning machine of claim 1, wherein the base body has an upper side, which faces away from the interior of the shell, and a lower side that faces the interior of the shell; and wherein there is no fluid connection through the base body between the interior of the shell and the upper side of the base body.

4. The floor cleaning machine of claim 1, wherein the distal ends of the bristles are arranged in the sweeping plane.

5. The floor cleaning machine of claim 1, wherein an inner side of the shell forms a shell angle with the rotation axis of at least 5 degrees and at most 85 degrees.

6. The floor cleaning machine of claim 5, wherein the shell angle is at least 20 degrees and at most 70 degrees.

7. The floor cleaning machine of claim 6, wherein the shell angle is at least 35 degrees and at most 55 degrees.

8. The floor cleaning machine of claim 1, wherein the flexible material is formed from a natural rubber.

9. The floor cleaning machine of claim 1, wherein the flexible material has a glass transition temperature of at most 0° C.

10. The floor cleaning machine of claim 1, wherein the flexible material has a Young's modulus of at most 5 GPa.

11. The floor cleaning machine of claim 1, wherein the shell is configured as a closed surface such that there is no fluid connection through the shell between the exterior of the shell and the interior of the shell.

12. The floor cleaning machine of claim 1, wherein the attachment section is adhesively bonded to the base body.

13. The floor cleaning machine of claim 1, further comprising a sweeping device having a rotary drive, wherein the base body of the disc broom is coupled to the rotary drive for rotation about the rotation axis.

14. The floor cleaning machine of claim 13, further comprising a chassis and a swept material receptacle, the chassis being configured to support the sweeping device for movement over a floor area that is to be cleaned;

wherein the disc broom is movable relative to the chassis into a working position;

wherein in the working position a partial quantity of the bristles engage with the floor area to be cleaned such that, when the rotary drive of the sweeping device rotates the base body about the rotation axis, swept material is conveyed from the floor area to be cleaned by the bristles to an inlet of the swept material receptacle.

15. The floor cleaning machine of claim 14, wherein in the working position the sweeping plane is arranged at a sweeping angle of more than 0 degrees to the floor area to be cleaned.

16. The floor cleaning machine of claim 14, further comprising a receiving container, and wherein the swept material receptacle is configured for conveying dust from the floor area to be cleaned into the receiving container.

17. The floor cleaning machine of claim 14, wherein the floor cleaning machine is selected from a group of floor sweeping machines consisting of sweepers, vacuum sweepers, scrubbing machines and vacuum scrubbing machines.

18. The floor cleaning machine of claim 14, wherein the cover element engages with the floor area to be cleaned when the disc broom is moved relative to the chassis into the working position.

19. The floor cleaning machine of claim 1, wherein the flexible material extends from the circumferential outer edge of the base body.

* * * * *